US008726604B2

(12) United States Patent
Hannig

(10) Patent No.: US 8,726,604 B2
(45) Date of Patent: May 20, 2014

(54) FLOOR PANEL WITH A PLASTIC BACKING

(75) Inventor: Hans-Juergen Hannig, Bergisch Gladbach (DE)

(73) Assignee: Akzenta Paneele + Profile GmbH, Kaisersesch (DE)

( * ) Notice: Subject to any disclaimer, the term of this patent is extended or adjusted under 35 U.S.C. 154(b) by 0 days.

(21) Appl. No.: 13/039,375

(22) Filed: Mar. 3, 2011

(65) Prior Publication Data

US 2011/0146177 A1 Jun. 23, 2011

Related U.S. Application Data

(63) Continuation of application No. PCT/EP2009/059488, filed on Jul. 23, 2009.

(30) Foreign Application Priority Data

Sep. 9, 2008 (DE) ..... 20 2008 012 001 U

(51) Int. Cl.
*E04B 2/00* (2006.01)

(52) U.S. Cl.
USPC ..... 52/592.1; 52/516

(58) Field of Classification Search
USPC ..... 52/309.3, 516, 592.1
See application file for complete search history.

(56) References Cited

U.S. PATENT DOCUMENTS

| | | | | |
|---|---|---|---|---|
| 3,029,416 | A * | 4/1962 | Quade | 360/220 |
| 6,505,452 | B1 * | 1/2003 | Hannig et al. | 52/582.1 |
| 7,037,024 | B2 * | 5/2006 | Steinwender | 403/267 |
| 2003/0003258 | A1 * | 1/2003 | Durso et al. | 428/53 |
| 2003/0009971 | A1 | 1/2003 | Palmberg | |
| 2004/0123547 | A1 * | 7/2004 | Grafenauer | 52/578 |
| 2004/0211144 | A1 * | 10/2004 | Stanchfield | 52/578 |
| 2005/0016107 | A1 | 1/2005 | Rosenthal et al. | |
| 2007/0107363 | A1 * | 5/2007 | Moriau et al. | 52/592.1 |
| 2008/0060311 | A1 * | 3/2008 | Moriau et al. | 52/592.1 |
| 2010/0154333 | A1 | 6/2010 | Peek et al. | |
| 2011/0138722 | A1 * | 6/2011 | Hannig | 52/309.1 |

FOREIGN PATENT DOCUMENTS

| | | | |
|---|---|---|---|
| CA | 2460580 | A1 | 3/2003 |
| CN | 1380926 | | 11/2002 |
| CN | 1685120 | | 10/2005 |
| DE | 199-44-399 | | 4/2001 |
| DE | 19944399 | A1 * | 4/2001 |
| DE | 102-12-324 | | 9/2003 |
| DE | 10212324 | | 10/2003 |
| EP | 1 229 181 | | 8/2002 |
| EP | 1 382 774 | | 1/2004 |

(Continued)

OTHER PUBLICATIONS

English machine translation of DE19944399A1.*

(Continued)

*Primary Examiner* — Branon Painter
(74) *Attorney, Agent, or Firm* — Lucas & Mercanti, LLP

(57) ABSTRACT

A floor panel having a backing of a plastics material that is pliable and flexible at the temperature at which a floor is used. A decorative layer disposed above the backing. Complementary mechanical locking profiles are provided on at least two edges of the panel and interact in the locked state of two floor panels. The locking profiles counteract movement apart of the floor panels. At least one of the locking profiles is provided, at least in certain regions, with at least one adhesive.

9 Claims, 3 Drawing Sheets

(56) References Cited

FOREIGN PATENT DOCUMENTS

Figure 1:
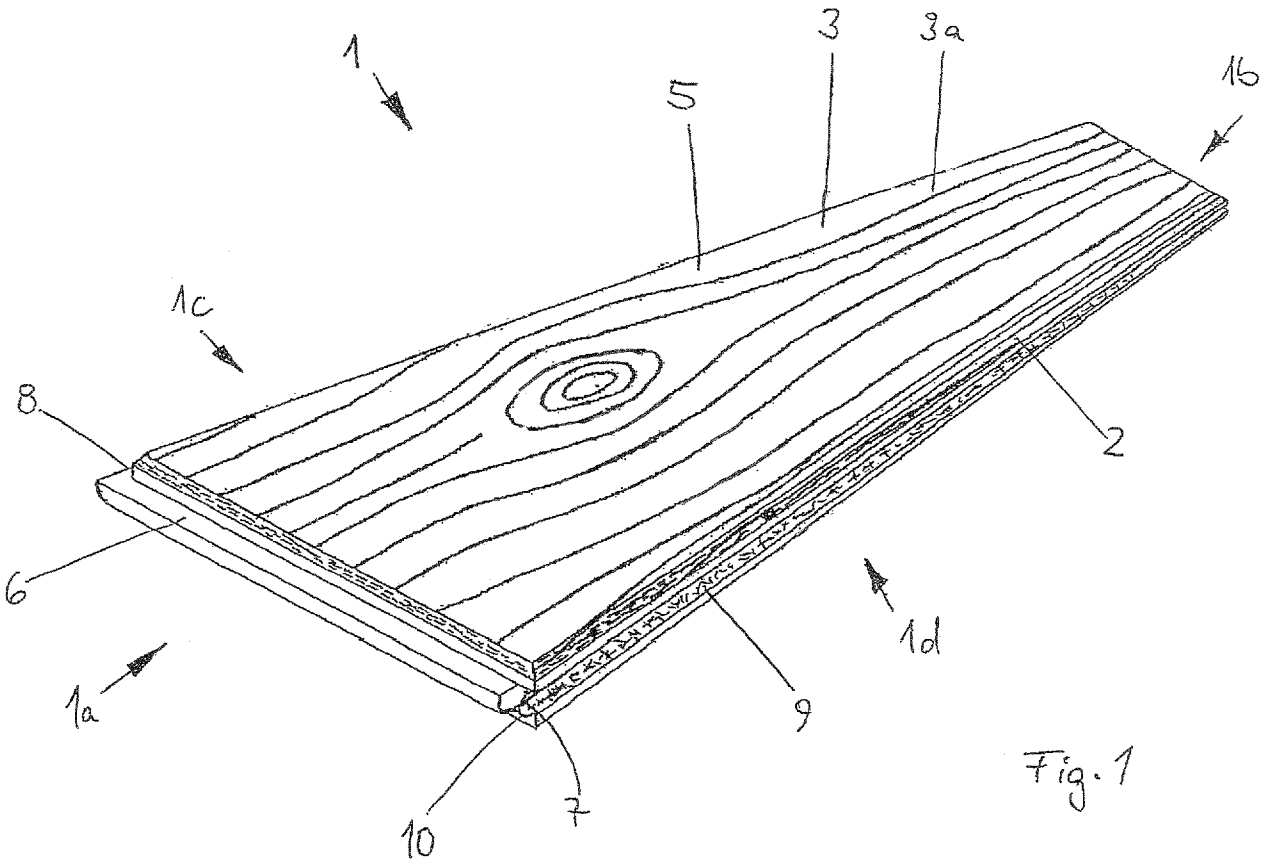

| | | | |
|---|---|---|---|
| EP | 1-382-774 | | 1/2004 |
| KR | 10-2004-0030601 | | 4/2004 |
| WO | 0194721 | | 12/2001 |
| WO | 02/092711 | | 11/2002 |
| WO | 02/092711 | A1 | 11/2002 |
| WO | 2007/040509 | | 4/2007 |
| WO | 2007040509 | | 12/2007 |

OTHER PUBLICATIONS

International Search Report PCT/EP2009/059488 (5 pages) and English Language Translation Thereof (8 pages).

The Korean Intellectual Property Office—Notice of Grounds for Rejection KR2011-7004177 in Korean with English language Translation (total of 8 pages).

Chinese Office Action, Application No. 200980134806.7 (6 pages).

* cited by examiner

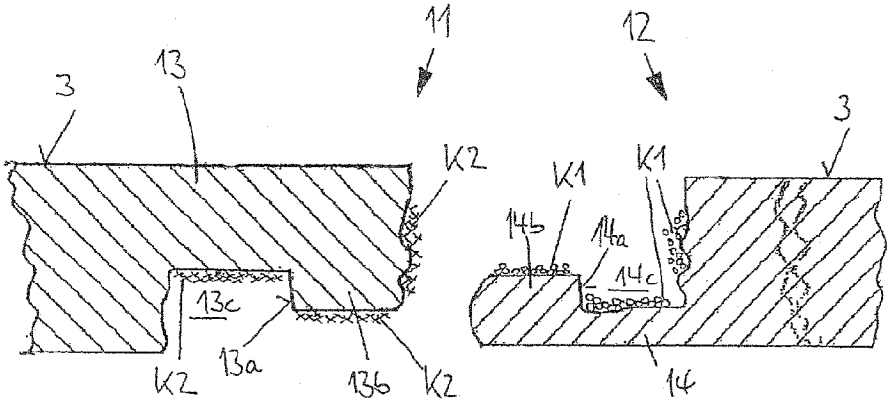
Fig. 2b
Fig. 2a
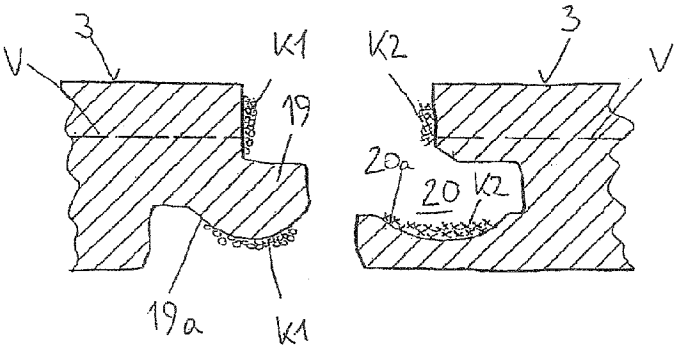
Fig. 3b
Fig. 3a

FLOOR PANEL WITH A PLASTIC BACKING

This is a Continuation of PCT/EP2009/059488 filed Jul. 23, 2009 which in turn claimed the priority of German Patent Application No. 20 2008 012 001.2 filed Sep. 9, 2008, the priority of both Applications are claimed and both applications are incorporated by reference herein.

The invention relates to a floor panel comprising a backing which exhibits a plastics material that is pliable and flexible at the temperature at which a floor is used, comprising a decorative layer disposed above the backing, comprising complementary mechanical locking means, which are provided at least two edges of the panel, interact in the locked state of the two floor panels and counteract movement apart of the floor panels.

A floor panel of this kind is known from DE 199 44 399 A1. It comprises a backing made of a plastics material that is pliable and yet largely resistant to dents. Hitherto, hard, rigid wood or wood-like materials have been used for the backing, but in the known floor panel this material is replaced by a plastics material.

In floor panels which are made of compacted fiberboard and which include mechanical locking means, the quality and strength of the mechanical locking decrease with a decreasing thickness of the backing. Compared thereto, a backing made of a plastics material exhibits a higher strength. It is thus possible to fabricate floor panels that have a lower overall thickness than floor panels that comprise a backing made of a wood fiber material.

A floor covering made up of floor panels of the described kind and essentially consisting of plastics material is suitable for a floating installation, i.e. the floor panels are supported loosely on the ground; an adhesive connection is omitted. Temperature fluctuations make the individual floor panels expand or shrink. The occurring forces burden the mechanical locking and can accordingly cause the floor panels to move apart thus forming a gap between the adjacent panel edges. Such gaps are considered to be unaesthetic in a floor covering. Moreover, the robustness of the surface of the floor covering is affected if such gaps are formed.

The invention is based on the object of providing a floor panel that is suitable for counteracting a gap formation.

According to the invention, this object is achieved by at least one of the locking means being provided at least in certain regions with at least one adhesive.

In the assembled state of two floor panels, the form fit of the locking means produces a mechanical locking. Additionally, the mechanical locking is reinforced by an adhesive connection that is also effective between the assembled mechanical locking means. The strength of the adhesive connection is achieved by the surface cohesion between the adhesive and the respective floor panel on the one side and by the internal strength of the adhesive itself.

A helpful further development provides an adhesive that is an activatable adhesive. By this solution, the user is offered the option to activate the adhesive or to leave the adhesive inactivated and instead lock the floor panels purely mechanically without an additional adhesive connection. This is an option, for example, if no excessive forces on the mechanical locking are to be expected. The user can also install and lock a flooring cover with the adhesive activated in some regions and non-activated in other regions. If the activation of the adhesive is omitted, it is very easy to unlock and collect the floor panels for their reuse or reinstallation. For instance, the activation of the adhesive can be effectuated at the second use and repeated installation of a floor covering.

Each of the complementary locking means can be provided with an adhesive at least in regions.

The adhesive preferably comprises two components which are cured as a result of a mutual contact.

One embodiment which comprises two components can either be designed in such a way that it offers the above-described option of activation of the adhesive. In this case, the floor panels can be selectively locked purely mechanically without an adhesive connection. On the other side, the two components of the adhesive can be applied in such a manner that the adhesive is necessarily activated during the process of the mechanical form-fit locking. It is possible, for example, to enclose an adhesive in micro capsules which are arranged, e.g. adhered, to the surface of the locking means. The micro capsules are designed in such a manner that they are destroyed by the process of form-fit locking, so that the adhesives contained therein leak from the capsules, react with each another and are cured.

Most simply, the first component of the adhesive is glue and the second component of the adhesive is a hardener. A contact of the first component and the second component causes a reaction by which the adhesive is cured.

To simplify the handling, especially during the installation and locking of the floor panels, the glue component of the adhesive can be factory-provided on a first one of the complementary locking means.

The handling of the floor panels can be additionally simplified by factory-providing the hardener component of the adhesive on a second one of the complementary locking means.

As a plastics material of the backing, a material from the group of thermoplastic elastomers can be provided. These are among others plastics materials based on polyolefin, polypropylene, polyurethane or polyamide.

On the other hand, as a plastics material of the backing, a material from the group of amorphous elastomers can be provided. But considering that the same exhibit a natural hardness and brittleness, amorphous elastomers of the type containing a plasticizer are provided, for instance the so-called soft polyvinylchloride (PVC).

The thickness of the floor panel preferably amounts to 1.5 mm to 6 mm.

The floor panel simply has four panel edges.

An expedient embodiment provides that at least one of two mutually opposite panel edges has a groove and the opposite panel edge has a tongue that is configured complementary to the groove.

An advantageous further development of the groove-and-tongue floor panel provides that the tongue and the groove each have an undercut, that the undercut of the tongue and the undercut of the groove are designed in such a way that in a locked state they counteract movement apart of the floor panels in their plane and vertically to the locked panel edge.

An additional advantageous further development provides that at least two mutually opposite panel edges are provided with complementary hook elements that can be locked with each other in a direction vertical to the plane of the floor panels.

Of course, it is also possible for a floor panel to be provided with a groove and a tongue on a first pair of mutually opposite panel edges and to include complementary hook elements on a second pair of mutually opposite panel edges.

The quality of the mechanical locking by the hook elements can be improved if each of the hook elements has an undercut which is designed in such a manner that in the locked state a hook connection is produced that counteracts movement apart of the floor panels vertically to the plane of the floor panels.

Additionally, for improving the dimensional stability, a reinforcement layer can be provided which includes for instance a fiber-reinforced material such as fiber glass etc. The reinforcement layer can be arranged as at least one intermediate layer in a split backing.

Figure 4:
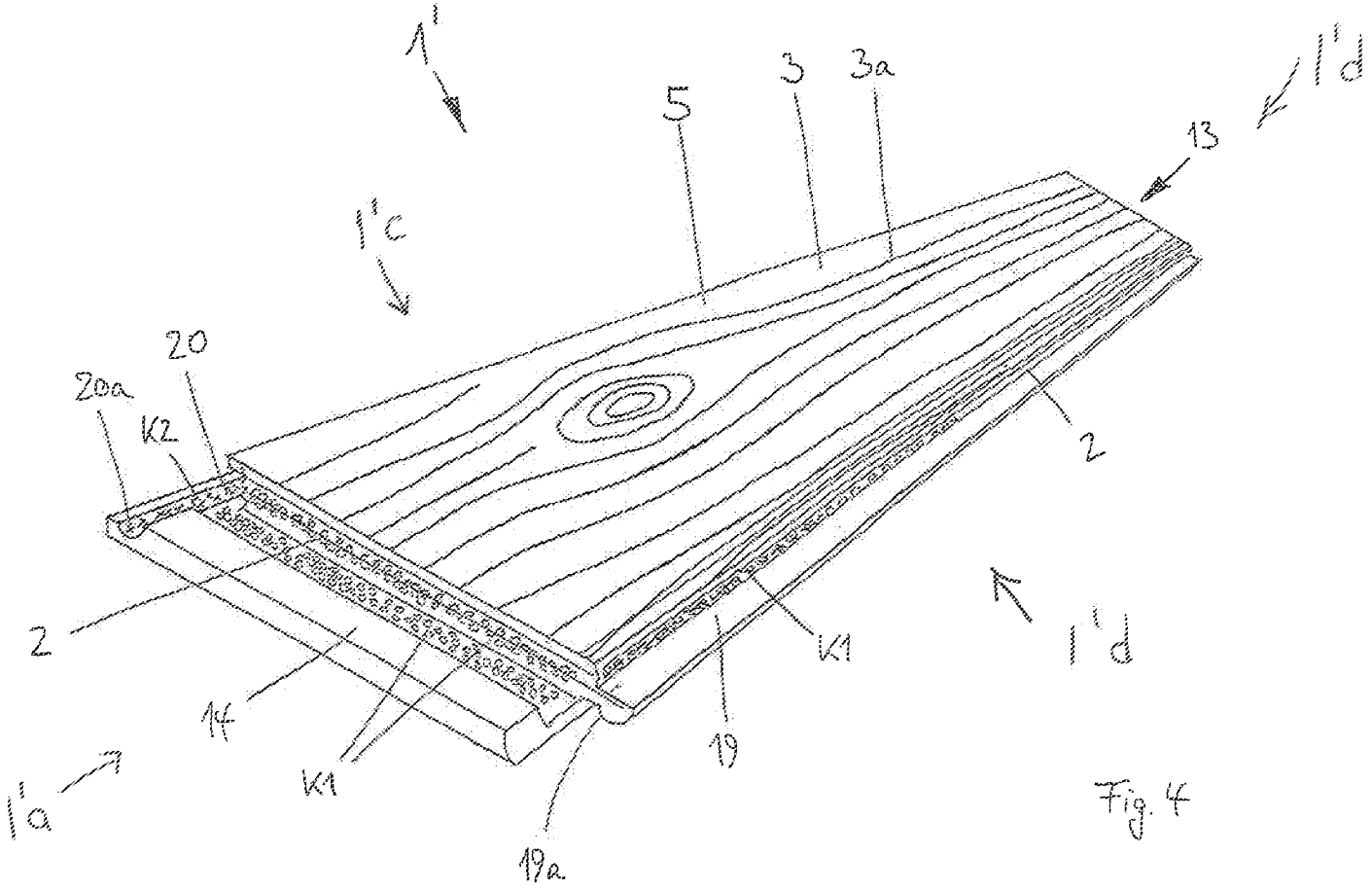

In the following the invention will be described by way of example and with reference to the attached drawing figures wherein it is schematically represented by:

FIG. 1 a perspective view of a floor panel including form-fit mechanical locking means on the panel edges;

FIGS. 2*a*, 2*b* parts of complementary hook elements as the same can be provided on mutually opposite panel edges of a floor panel;

FIGS. 3*a*, 3*b* parts of panel edges including an undercut tongue which is configured complementary to a panel edge including an undercut groove, as they can be provided on opposite panel edges of a floor panel;

FIG. 4 a perspective view of a floor panel including a groove and a tongue on a first pair of mutually opposite panel edges and complementary hook elements on a second pair of mutually opposite panel edges.

Illustrated in FIG. 1 is a floor panel 1 according to the invention including panel edges 1*a*, 1*b* and 1*c*, 1*d*. It comprises a backing 2 made of a pliable and flexible plastics material. Above backing 2 a decorative layer 3 is disposed. The decorative layer 3 exhibits a reproduction of a wood grain 3*a*. On the decorative layer 3 a transparent wear protection layer 5 is provided. Mechanical locking means are provided, namely a first pair of panel edges 1*a* and 1*b*, the panel edge 1*a* thereof includes a tongue 6 having an undercut 7. The opposite panel edge 1*b* is provided with a groove formed complementary to the tongue 6. A second pair of mutually opposite panel edges is also provided with a panel edge 1*c* that includes a tongue 8 having an undercut while the opposite panel edge 1*d* includes a groove 9 with an undercut 10 formed complementary to the tongue 8.

Besides these mechanical locking means also other kinds of mechanical locking means can be provided on one or both pairs of mutually opposite panel edges.

In addition to the mechanical locking, the edge 1*d* is provided in regions thereof with an adhesive K1 that serves for producing an adhesive connection. In the assembled state of two floor panels the adhesive connection Is also effective between the mechanical locking means.

The FIGS. 2*a* and 2*b* show panel edges 11 and 12 including mechanical locking means in the form of hook elements 13 and 14. The hook elements 13 and 14 each have an undercut surface 13*a* respectively 14*a* which in the assembled state of two floor panels prevents movement apart of the floor panels in their panel plane and also vertically to the locked panel edge 11 respectively 12. The undercut surfaces provided for this purpose are provided on a part 13*b* respectively 14*b* of the respective hook element which protrudes vertically to the panel plane. Adjacent to the vertically protruding part 13*b* respectively 14*b* a hook recess 13*c* respectively 14*c* is provided which is configured in such a way that the vertically protruding part 13*b* respectively 14*b* of the hook element of the adjacent floor panel fits in this hook recess 13*c* respectively 14*c*.

The panel edges 11 and 12 are provided in regions thereof with an adhesive. The adhesive comprises a first component K1 that is disposed on the panel edge 12 and a second component K2 that is disposed on the panel edge 11. The component K1 is glue. In the assembled state of the two panel edges 11 and 12, the glue K1 cures as a result of the reaction with the hardener K2. The form-fit connection of the panel edges 11 and 12 is reinforced by a material engagement of the adhesive connection.

The FIGS. 3*a* and 3*b* show panel edges including a different type of complementary locking means, namely locking means on the basis of a groove and a tongue as already included in the embodiment according to FIG. 1. The panel edge according to FIG. 3*a* has a tongue 19 with an undercut 19*a* while the panel edge according to FIG. 3*b* includes a groove 20 with undercut 20*a* formed complementary to the tongue 19. For locking the groove and the tongue, the floor panel having the tongue 19 is angled in an inclined fashion and the tongue 19 is inserted in the groove 20. Thereafter, the angled floor panel is pivoted downward to the plane of the other floor panel thus producing a form-fit mechanical locking.

The panel edges according to the FIGS. 3*a* and 3*b* are also provided in regions thereof with an adhesive. The adhesive comprises a first component K1 that is disposed on the panel edge having the tongue 19 and a second component K2 that is disposed on the panel edge having the groove 20. The component K1 is glue and the component K2 is a hardener. In the assembled state of the groove 19*a* and the tongue 20, the glue K1 is cured as a result of the reaction with the hardener K2. Also this form-fit connection of the panel edges is reinforced by material engagement of the adhesive connection.

According to the FIGS. 3*a* and 3*b* a decorative layer 3 is provided on an upper face of the floor panel. As indicated by the dashed line, the backing can be split, with a reinforcement layer V being provided that improves the dimensional stability of the floor panel.

FIG. 4 shows in a perspective view an alternative floor panel 1' that includes on a first pair of mutually opposite panel edges 1'*c* and 1'*d* complementary locking means in the form of a tongue 19 having an undercut 19*a*. The tongue 19 is provided on a panel edge 1'*d*. A complementary groove 20 having an undercut 20*a* is provided on the opposite panel edge 1'*c*. The second pair of panel edges 1'*a* and 1'*b* includes complementary hook elements 13 respectively 14 as described by way of the FIGS. 2*a* and 2*b*. The alternative floor panel 1' comprises a backing 2 made of a pliable and flexible plastics material. Above the backing 2 a decorative layer 3 is disposed. The decorative layer 3 carries a reproduction of a wood grain 3*a*. On the decorative layer 3 a transparent wear protection layer 5 is provided.

LIST OF REFERENCE NUMBERS

1 floor panel
1*a* panel edge
1*b* panel edge
1*c* panel edge
1*d* panel edge
2 backing
3 decorative layer
3*a* wood grain
5 wear protection layer
6 tongue
7 undercut
8 tongue
9 groove
10 undercut
11 panel edge
12 panel edge
13 hook element
13*a* undercut surface

13*b* vertically protruding part
14 hook element
14*a* undercut surface
14*b* vertically protruding part
19 tongue
19*a* undercut
20 groove
20*a* undercut
V reinforcement layer
K1 first component (glue)
K2 second component (hardener)

The invention claimed is:

1. A floor panel for mechanically locking with another floor panel, the floor panel and the another floor panel each having four panel edges and each having complementary mechanical locking means on mutually opposite edges such that one of the locking means on the floor panel interacts with one of the locking means on the another floor panel and forms a locked state to counteract movement apart of the floor panel and the another floor panel, the floor panel comprising:

a backing comprising a plastics material that is pliable and flexible, the backing being a split backing further comprising one or more intermediate layers;

a reinforcement layer arranged as at least one intermediate layer in the split backing, the reinforcement layer comprising a fiber-reinforced material;

a decorative layer different from the reinforcement layer, the decorative layer being disposed above the backing;

a first complementary mechanical locking means on a first pair of mutually opposite edges of the floor panel being complementary hook elements that lock in a direction vertical to the plane of the floor panel;

each of the complementary hook elements having a vertical, recess defined by a horizontal protruding part which is a horizontal extension of one horizontal surface of the floor panel and a vertical protruding part at a distal end of the horizontal protruding part, each vertical protruding part having an undercut surface that is transverse to a horizontal plane of the floor panel and abuts an other undercut surface of the vertical protruding part of the complementary hook element of the another floor panel in the locked state, and counteracts movement apart of the floor panel from the another floor panel in the plane of the floor panel;

an optionally activatable adhesive provided at least in certain regions of the complementary hook elements, the adhesive being optionally activatable when the floor panel is in the locked state, the adhesive is not provided on the undercut surface of the complementary hook elements, a second complimentary mechanical locking means on a second pair of mutually opposite edges being a complementary tongue and groove, one of mutually opposite panel edges is provided with the groove and the opposite panel edge is provided with the tongue formed complementary to the groove, the tongue and the groove each include an undercut, the undercut of the tongue and the undercut of the groove are designed in such a manner to counteract movement apart in the locked state in the plane of the floor panel, the undercut of the tongue and the undercut of the groove each having the adhesive.

2. The floor panel according to claim 1, wherein the adhesive comprises two components.

3. The floor panel according to claim 2, wherein the components are factory-provided on a first one of the looking means.

4. The floor panel, according to claim 2, wherein the components are factory-provided on a second one of the locking means.

5. The floor panel according to claim 1, wherein the plastics material of the backing is a thermoplastic elastomer.

6. The floor panel according to claim 1, wherein the plastics material of the backing is an amorphous elastomer.

7. The floor panel according to claim 6, wherein the plastics material is polyvinylchloride.

8. The floor panel according to claim 1, wherein the floor panel has a thickness of 1.5 mm to 6 mm.

9. Two locking floor panels, each of the panels comprising: four panel edges;

a backing comprising a plastics material that is pliable and flexible, the backing being a split backing further comprising one or more intermediate layers;

a reinforcement layer arranged as at least one intermediate layer in the split backing, the reinforcement layer comprising a fiber-reinforced material;

a decorative layer different from the reinforcement layer, the decorative layer being disposed above the backing;

complementary mechanical locking hook elements provided on a first pair of mutually opposite edges of each of the panels, one of the hook elements of one of the panels capable of interacting with an other hook element of the other of the panels in a locked state of the two floor panels and counteract movement apart of the two floor panels, the complementary mechanical locking hook elements locking in a direction vertical to a horizontal plane of the panels;

each of the hook elements having a vertical, recess defined by a horizontal protruding part which is a horizontal extension of one horizontal surface of the floor panel and a vertical protruding part at a distal end of the horizontal protruding part, each vertical protruding part having an undercut surface that is vertical, to the horizontal, plane of the panels, an undercut surface of one of the hook elements of one of the panels abutting an undercut surface of an other of the hook elements of an other of the panels when the panels are in the locked state so as to counteract movement apart of the panels in the horizontal, plane of the panels;

an optionally activatable adhesive provided at least in certain regions of both the one and the other hook elements, the adhesive is optionally activatable when the two floor panels are in a locked state; and the undercut surface of each of the hook elements having no adhesive, complementary mechanical locking tongue and groove provided on a second pair of mutually opposite edges of each of the panels, the tongue on one of the mutually opposite edges and the groove on an other of the mutually opposite edges, the tongue and the groove each include an undercut, the undercut of the tongue and the undercut of the groove are designed in such a manner to counteract movement apart in the locked state in the plane of the floor panel, the undercut of the tongue and the undercut of the groove each having the adhesive.

* * * * *